US008708661B2

(12) United States Patent
Lee et al.

(10) Patent No.: US 8,708,661 B2
(45) Date of Patent: Apr. 29, 2014

(54) COMPRESSOR WITH OIL LEVEL CONTROLLER

(75) Inventors: Yunhi Lee, Seoul (KR); Jangwoo Lee, Seoul (KR); Seungjun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 333 days.

(21) Appl. No.: 13/035,493

(22) Filed: Feb. 25, 2011

(65) Prior Publication Data

US 2011/0211973 A1 Sep. 1, 2011

(30) Foreign Application Priority Data

Feb. 26, 2010 (KR) ..... 10-2010-0018128

(51) Int. Cl.
*F04B 49/00* (2006.01)

(52) U.S. Cl.
USPC ..... 417/13; 417/44.1; 417/211.5; 417/228

(58) Field of Classification Search
USPC ..... 417/13, 33, 44.1, 14, 32, 36, 38, 211.5, 417/228; 62/192, 193
See application file for complete search history.

(56) References Cited

U.S. PATENT DOCUMENTS

| | | | | | |
|---|---|---|---|---|---|
| 4,090,371 | A * | 5/1978 | Keane | 62/129 |
| 4,780,067 | A | 10/1988 | Suzuki et al. | 417/441 |
| 4,870,831 | A * | 10/1989 | Kitamoto | 62/84 |
| 5,765,994 | A * | 6/1998 | Barbier | 417/12 |
| 7,316,541 | B2 * | 1/2008 | Baron | 417/13 |
| 7,540,718 | B2 * | 6/2009 | Funami et al. | 417/211.5 |
| 2006/0013697 | A1 * | 1/2006 | Uratani | 417/36 |
| 2011/0138831 | A1 * | 6/2011 | Ogata et al. | 62/193 |
| 2011/0239672 | A1 * | 10/2011 | Won et al. | 62/193 |

FOREIGN PATENT DOCUMENTS

| | | | | |
|---|---|---|---|---|
| CN | 1580565 | A | 2/2005 | |
| CN | 101086258 | A | 12/2007 | |
| CN | 101191477 | A | 6/2008 | |
| JP | 01219372 | A * | 9/1989 | F04B 49/06 |
| JP | 04318299 | A * | 11/1992 | F04C 29/10 |
| JP | 3178287 | B2 | 6/2001 | |
| KR | 10-0602230 | B1 | 7/2006 | |
| WO | WO 2010021137 | A1 * | 2/2010 | F25B 9/06 |

OTHER PUBLICATIONS

English Abstract of JP01219372A dated Sep. 1989.*
English Abstract of JP04318299A dated Nov. 1992.*
Chinese Office Action dated Mar. 27, 2013 issued in Application No. 201110049425.8 (with English translation).

* cited by examiner

*Primary Examiner* — Devon Kramer
*Assistant Examiner* — Nathan Zollinger
(74) *Attorney, Agent, or Firm* — KED & Associates, LLP

(57) ABSTRACT

A compression device includes a controller to control an operating speed of a compressor based on a detected level of oil in an oil storage area. During a speed-change operation, the controller controls acceleration of the compressor to maintain the oil level within a predetermined range when the oil level is detected to be outside the predetermined range.

17 Claims, 5 Drawing Sheets

COMPRESSOR WITH OIL LEVEL CONTROLLER

CROSS-REFERENCE TO RELATED APPLICATION

Pursuant to 35 USC §119(a), this application claims benefit of the filing date and right of priority to Korean Application No. 10-2010-0018128, filed on Feb. 26, 2010, the contents of which is incorporated by reference herein in its entirety.

BACKGROUND

1. Field

One or more embodiments described herein relate to a compressor.

2. Background

Generally, a compressor used in a refrigerator, an air conditioner, etc. has a configuration that a compression part for sucking and compressing a refrigerant is installed below a casing, and a motor part is installed above the compression part. The compression part and the motor part are connected to one shaft. Under this configuration, the shaft is rotated by a driving force generated through the motor part. By the rotation of the shaft, the compression part coupled to the shaft is driven to perform a compression operation.

In order to smoothly rotate the compression part, oil has to be supplied to bearing, a rolling piston, etc. of the compression part. Generally, the oil is stored at a lower part of a casing, and is pumped by an oil feeder installed at a lower end of the shaft to be supplied to the compression part. The oil serves not only to perform a lubrication operation, but also to cool the motor part. Therefore, for an enhanced lifespan and efficiency, control of a proper amount of oil to the compressor should be stably supplied.

One type of compressor is configured to be driven at a constant speed in a normal driving mode. Accordingly, a proper amount of oil can be supplied to the compressor only if a proper amount of oil is supplied into a casing, in a condition that the compressor is not mechanically damaged or mal-operated. For an efficient driving, a compressor capable of having an increased or decreased operating speed is being widely used. As a representative example of the compressor, there is provided a compressor having a Brush-Less Direct Current (BLDC) motor.

In case of this BLDC motor, acceleration is irregularly increased and decreased during an operation. This irregular increment or decrement may influence on a level of oil stored at a lower portion of a casing. This may temporarily lower an oil level according to changes of the operating speed even in a state that the casing is supplied with a proper amount of oil therein. As a result, oil may not be smoothly supplied into the compression part. This may lower the efficiency and shorten the lifespan of the compressor.

DETAILED DESCRIPTION

Figure 1:
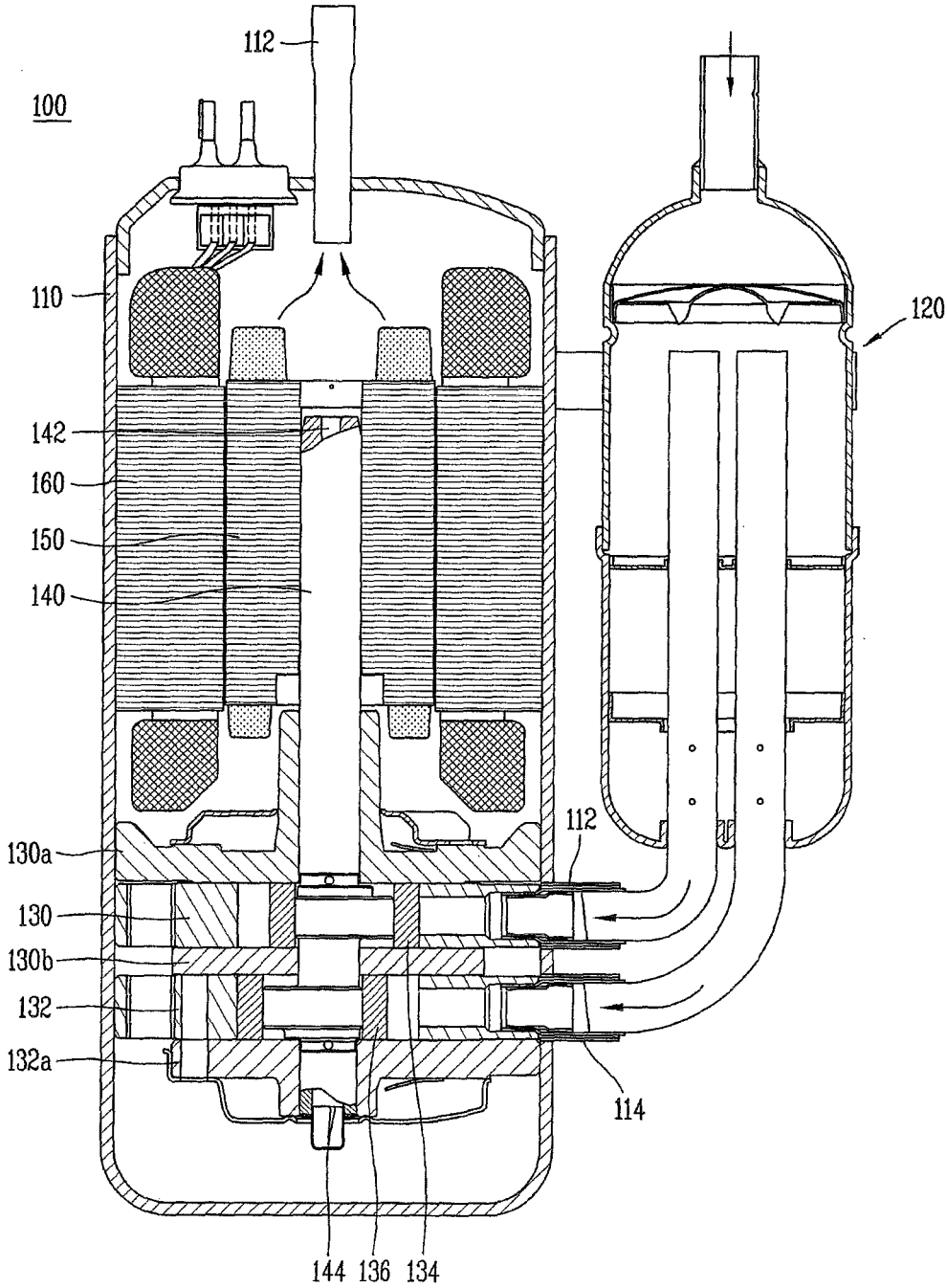
FIG. 1 shows one embodiment of a compressor.

FIG. 1 is a sectional view of a compressor according to a first embodiment of the present disclosure. The compressor of FIG. 1 is a rotary compressor, and largely includes a casing 110 and an accumulator 120 disposed at one side of the casing 110. The accumulator 120 vaporizes a liquid included in a mixture of a refrigerant and oil, discharged from the compressor and returning to the compressor after circulating a device connected to the compressor, e.g., a refrigerator, an air conditioner, etc. The accumulator 120 is communicated with an upper suction pipe 112 and a lower suction pipe 114 installed at one side of the casing 110, respectively. In some cases, the accumulator 120 may not be provided. A discharge pipe 112 is installed above the casing 110, through which a compressed refrigerant is discharged to outside.

The upper suction pipe 112 and the lower suction pipe 114 are communicated with an upper cylinder 130 and a lower cylinder 132 disposed below the casing 110, respectively. That is, the compressor is implemented as a 'two-stage' type having two cylinders. However, the compressor of the present disclosure is not limited to the 'two-stage' type having two cylinders. An upper bearing 130*a* is installed above the upper cylinder 130, and a lower bearing 132*a* is installed below the lower cylinder 132. An intermediate plate 130*b* is installed between upper cylinder 130 and lower cylinder 132.

Under this structure, the upper cylinder 130, the upper bearing 130*a* and the intermediate plate 130*b* form an upper compression chamber, and the lower cylinder 132, the lower bearing 132*a* and the intermediate plate 130*b* form a lower compression chamber. An upper rolling piston 134 and a lower rolling piston 136 are installed in the upper compression chamber and the lower compression chamber, respectively. As the upper rolling piston 134 and the lower rolling piston 136 are eccentrically rotated, a refrigerant is sucked into the upper and lower compression chambers, compressed and discharged therefrom.

The upper rolling piston 134 and the lower rolling piston 136 are eccentrically installed on a shaft 140. The shaft 140 is disposed in a longitudinal direction of the casing 110, and an oil path 142 is penetratingly formed in the shaft 140. An oil groove 144 is formed below the shaft 140. Under this configuration, when the shaft 140 is rotated, oil stored at a lower portion of the casing 110 is transferred to an upper side of the casing along the oil path 142 and the oil groove 144.

A rotor 150 is installed above the shaft 140, and a stator 160 is fixedly installed in the casing 110 toward outside of the rotor 150. The rotor and the stator constitute a motor for rotating the shaft 140. The motor is configured to have a variable rotation speed by a controller (not shown), e.g., an inverter.

Figure 2:
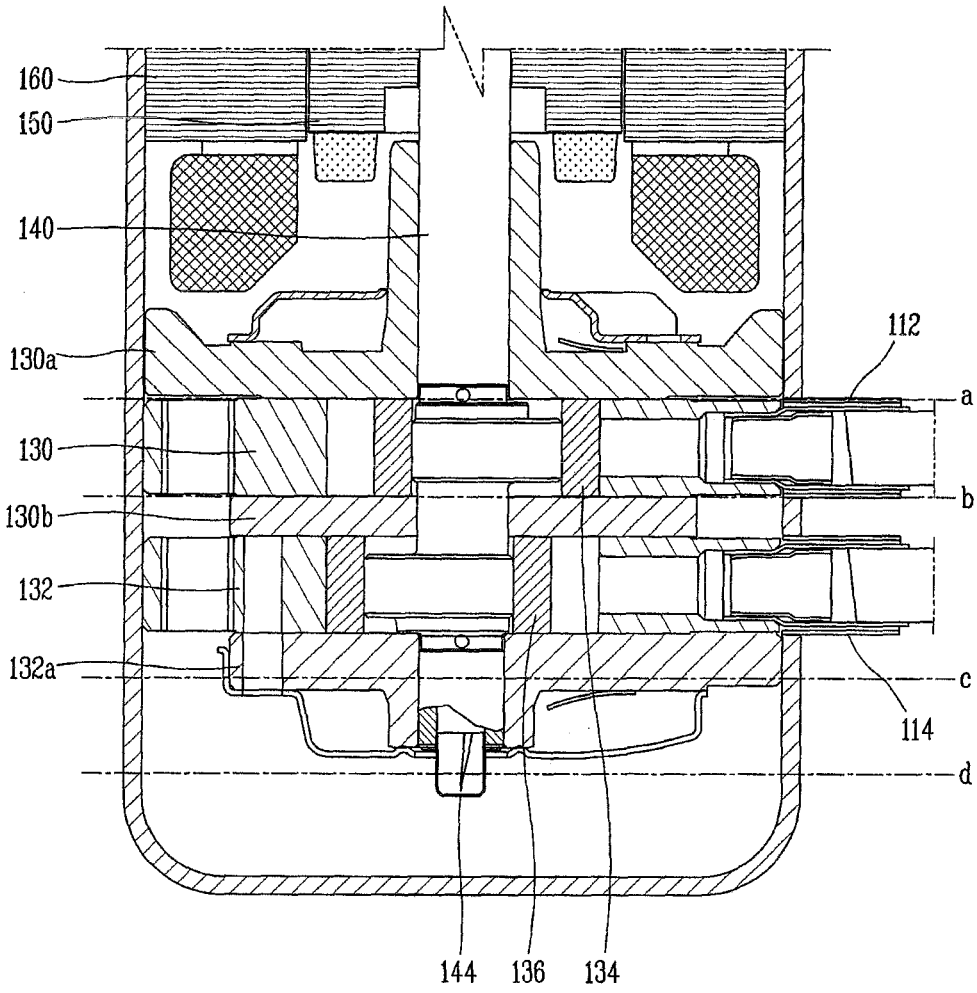
FIG. 2 shows a lower part of a casing of the compressor.

FIG. 2 is an enlarged sectional view of a lower portion of the casing 110 FIG. 1. Referring to FIG. 2, the lower portion of the casing 110 serves as a space for storing oil therein. When the compressor is operated, a level of the oil stored at a lower portion of the casing level is changed. This change of an oil level may be categorized into an absolute change due to oil loss or oil leakage, and a temporary change due to a change of an operating speed of the compressor. This oil level has to be maintained properly while the compressor is operated, such that the compressor is normally operated.

In FIG. 2, the level 'a' indicates an oil level before the compressor is operated. Here, the 'a' corresponds to a height of an interface between the upper cylinder and the upper bearing. The levels 'b' and 'd' respectively correspond to a highest oil level and a lowest oil level where the compressor can be normally operated. More concretely, the 'b' corresponds to an interface between the intermediate plate and the upper cylinder, and the 'd' corresponds to a height of a lowermost portion of an oil feeder. That is, when the oil level is lower than the level 'd', oil supply by the oil feeder is not performed. Accordingly, the oil level has to be always more than the level 'd' while the compressor is operated.

The level 'c' is optional, which corresponds to an oil level for determining whether a user has taken a mistake or not. More concretely, the level 'c' corresponds to a height of an upper end of the oil feeder. When the oil level is more than the level 'c', the oil feeder is completely soaked in oil.

The level 'c' will now be explained in more detail. When a customer purchases a compressor, the customer writes a contract to maintain an oil level as a level more than the level 'c' during an operation of the compressor. Then, when repairing the compressor, an engineer checks whether the customer has maintained an oil level as a level less than the level 'c'. According to a result of the check, the compressor is repaired free or with charges. Here, the positions of the lines may be arbitrarily set.

Figure 3A:
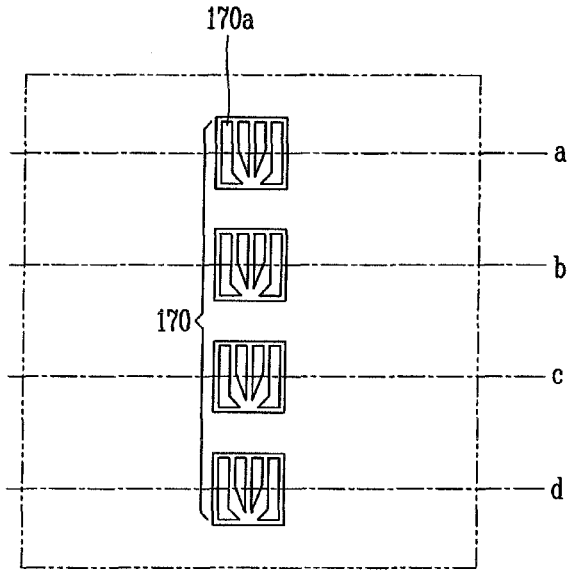
FIGS. 3A and 3B are views of a level sensor of the compressor.
Figure 3B:
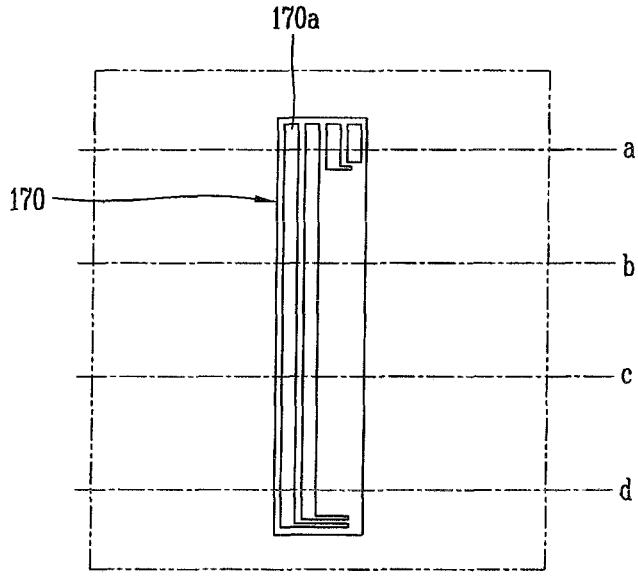

The compressor is provided with a level sensor 170 for checking an oil level. The level sensor 170 is installed on a lower inner wall surface of the casing 110. As shown in FIG. 3A, a plurality of level sensors may be disposed in parallel in a height direction of the casing. As shown in FIG. 3B, one level sensor may be extendingly installed between the highest oil level and the lowest oil level.

In FIG. 3A, a plurality of level sensors are disposed to be consistent with the levels 'a' to 'd', respectively. In FIG. 3B, an upper end of the level sensor is positioned to be higher than the level 'a', and a lower end thereof is positioned to be lower than the level 'c'. Each sensor may be fabricated by processing a metallic thin film by etching, etc. Here, any sensor rather than the aforementioned sensors may be used.

Each level sensor is a thermal sensor using a heating wire. The level sensor detects whether a fluid such as oil has contacted thereto by detecting a change of a heat transfer property of heat generated by conducting a fluid near a heating wire. Through this detection, an oil level is measured.

The level sensor includes a thin film type heating wire fabricated by etching, and the thermal sensor measures temperature changes by applying a direct current (DC) or an alternating current (AC). In case of applying a direct current, the heating wire is heated to measure an equilibrium temperature of the sensor. In case of applying an alternating current, the heating wire is heated to measure amplitudes of temperature changes.

In case of a direct current, measurement procedures are relatively simple. However, it takes a long time for the level sensor to reach an equilibrium temperature. Accordingly, a reaction speed may be slow, and measurement errors may occur due to influences from an external temperature. On the other hand, in case of an alternating current, the level sensor reaches an equilibrium temperature very instantaneously. Accordingly, a reaction speed may be fast, and influences from an external temperature may be removed.

Therefore, the level sensor 170 performs a temperature measurement by applying an alternating current. Here, a three-omega method may be used. The three-omega method measures a thermal property (thermal conductivity, volumetric thermal capacity) of a solid or liquid material by using a thin film type heating wire. As the thin film type sensor is used, a depth of thermal penetration is shallow. Accordingly, the sensor may reach a quasi-equilibrium temperature rapidly, and influences from external movements or vibrations may be reduced.

Furthermore, the thin film type sensor has a structure that an area with respect to a volume is large and a heat accumulator is small. Accordingly, the thin film type sensor is sensitive to a change of an external medium, and has a rapid reaction speed. Furthermore, the thin film type sensor can be miniaturized, and is advantageous for massive productions using MEMS techniques.

Thin film heating wires 170*a* of the level sensors 170 shown in FIGS. 3A and 3B are connected to four electrodes (not shown) for supplying alternating currents and reading voltage signals. Accordingly, if a current having an angular frequency of $\omega$ is applied to the thin film heating wires 170*a* through the electrodes, a temperature and a resistance having an angular frequency of $2\omega$ are changed. The changed resistance having an angular frequency of $2\omega$ is multiplied with the current having an angular frequency of w, thereby being represented as a voltage signal having an angular frequency of $3\omega$. The resistance changes of the thin film heating wires implement a function of a temperature. Accordingly, temperature changes of the thin film heating wires may be measured from the voltage signal having an angular frequency of $3\omega$.

Amplitudes of the temperature changes of the thin film heating wires are determined by thermal properties of oil and the thin film, lengths and widths of the thin film heating wires, and heating frequencies. Here, the thermal property of the thin film, the length, the width, and the heating frequency are preset values. Accordingly, the amplitudes of the temperature changes of the thin film heating wires are determined by a thermal property of a material contacting the thermal film heating wires.

In one embodiment, a material contacting the thin film heating wires is oil or air. The thermal property of the thin film heating wires is very different from that of a material contacting the thin film heating wires. Accordingly, whether oil has contacted the thin film heating wires or not may be determined through the amplitudes of the temperature changes. The level sensor is not limited to a specific type, but may include any type of sensors capable of detecting an oil level by contacting oil.

Figure 4:
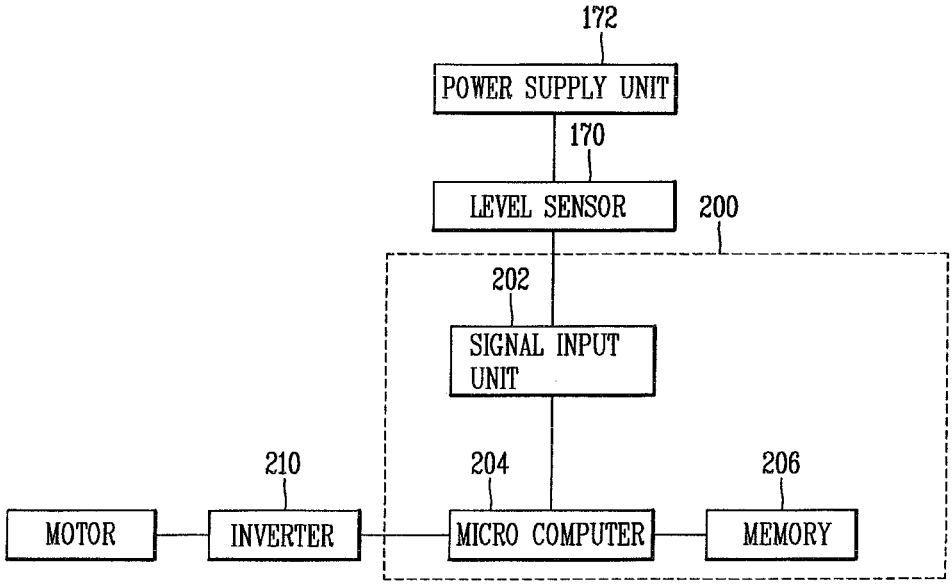
FIG. 4 shows an example of a controller for the compressor.

FIG. 4 shows an example configuration of a controller for controlling the compressor. The controller 200 includes a signal input unit 202 connected to the level sensor 170, and a micro computer 204 serving as a signal processor for processing a signal inputted from the signal input unit 202. A power supply unit 172 configured to supply an alternating current to the thin film heating wires 170*a* is connected to the level sensor 170.

The controller 200 includes a memory 206 configured to store therein each kind of information required to operate the controller, and information on an oil level measured by the level sensor 170.

The controller 200 is electrically connected to an inverter 210, and the inverter 210 is electrically connected to the aforementioned motor consisting of the stator and the rotor. The inverter 210 controls a rotation speed of the motor by commands from the controller 200. A preferred embodiment will be explained with reference to FIG. 5.

Figure 5:
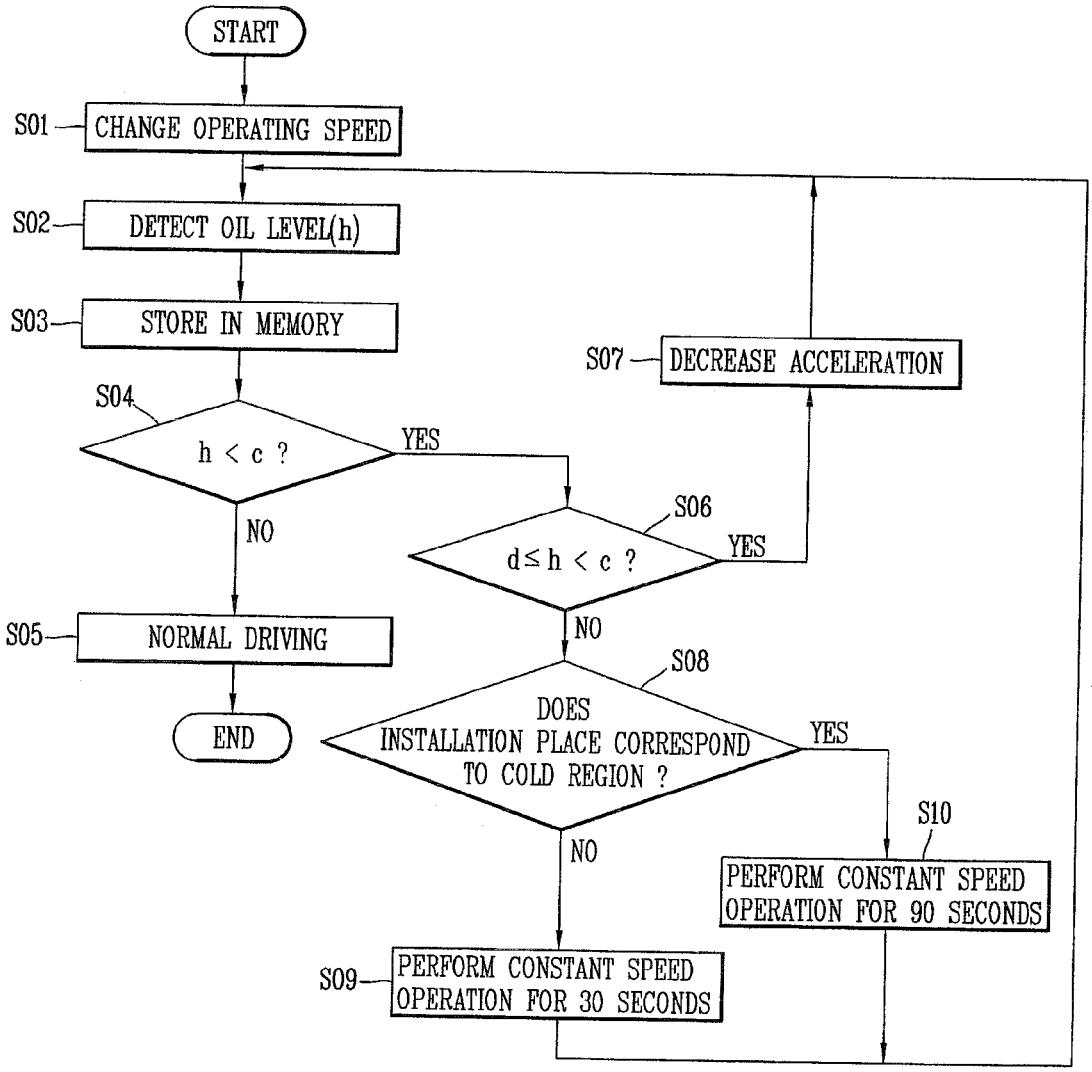
FIG. 5 shows steps included in one embodiment of a method for controlling the compressor.

FIG. 5 shows one embodiment of a method for controlling an operating speed of the compressor for changes. Firstly, in step of changing an operating speed (S01), an oil level (height: h) is continuously detected through the level sensor 170 (S02). This detected level (h) is stored in the memory 206 (S03), which may be utilized as information through which a usage history of the compressor, etc. are checked later. In some cases, S03 may be omitted. S03 may not be necessarily performed in the aforementioned order, but may be performed before or after any step to be later explained.

After S03, the level (h) detected through the micro computer 204 is compared with the level 'c' (S04). More concretely, in S04, it is checked whether the detected oil level is within a normal range. Actually, a level of initially-introduced oil is not increased during an operation. Accordingly, in S04, it is checked whether the substantially-detected level (h) is lower than the level 'c'.

If it has been checked in S04 that the detected level (h) is higher than the level 'c', the current process returns to S05 to maintain a normal operation. On the other hand, if it has been checked in S04 that the detected level (h) is lower than the level 'c', the current step undergoes S06.

In S06, the oil level (h) is compared with the levels 'd' and 'c'. If it has been checked in S04 that the detected level (h) is lower than the level 'c', an acceleration is high and thus oil forcibly transferred in the previous step does not return to inside of the system. Accordingly, the acceleration has to be lowered to temporarily increase a supply amount to the system. On the other hand, if it has been checked in S04 that the detected level (h) is lower than the level 'd', an oil collection amount has to be increased more rapidly, and the acceleration has to be stopped.

In S06, it is checked whether the detected level (h) is higher than the lowest level 'd'. If the detected level (h) is higher than the lowest level 'd', oil supply can be performed to some degrees. Accordingly, the current process returns to S07 to decrease the acceleration, and then returns to S02 to repeat the aforementioned procedures.

If it is checked in S06 that the detected level (h) is lower than the lowest level 'd', the acceleration has to be stopped and a constant speed has to be maintained. Here, a time to maintain an operating speed of the compressor is differently set according to an installation place of the compressor. For instance, in case of a cold region such as a polar region, an oil viscosity is relatively high. Accordingly, a returning speed becomes also slow.

In S08, it is checked whether an installation place of the compressor corresponds to a cold region. According to a check result in S08, S09 or S10 is performed to stop acceleration of the compressor and to perform a constant speed operation for a predetermined time. Here, an operating speed in the constant speed operation mode is set as an operating speed corresponding to a time point when S06 is performed, i.e., the level (h) is lower than the 'd'. Alternatively, the constant speed operation may be performed at a much lower operating speed according to a difference between the detected level (h) and the 'd'.

Since an oil collection amount from the system is larger than an oil supply amount to the system, an oil level may be increased. Accordingly, if the compressor can start to be operated in a state that a sufficient amount of oil has been supplied thereinto, an oil level can be within a normal range through the steps. However, an oil supply amount may not be sufficient, or oil loss may occur due to damages of a device, oil leakage, etc. For prevention of these problems, the present disclosure may further include detecting an oil level again after S09 or S10, and stopping the operation of the compressor when the oil level is not within a normal range.

In some cases, an oil level may be detected at an initial stage of the operation. More concretely, when the compressor starts to be operated, an oil level may be detected. Then, if it has been detected that the oil level is lower than a minimized height, the controller may control the compressor not to be operated.

One or more embodiments described herein, therefore, provide a compressor capable of controlling an oil level to maintain a proper or predetermined level while increasing or decreasing acceleration.

In accordance with one embodiment, the compressor includes a casing having an oil storage portion at a bottom portion thereof, a compression unit installed inside the casing and configured to intake and compress working fluid, a driving unit mechanically connected to the compression unit and actuating the same, an oil level detector installed inside the casing and configured to detect an oil level of the oil storage portion, and a controller configured to control an operating speed of the compression unit based on the detected oil level of the oil storage portion, wherein the controller adjusts an acceleration of the operating speed of the compression unit to maintain the oil level of the oil storage portion within a desired range when the oil level exceeds the desired range while changing the operating speed.

After researching changes of an oil level when increasing or decreasing the operating speed, the present inventors observed that the oil level is changed due to a difference between an oil supply amount and an oil collection amount. More concretely, at the time of acceleration, an oil discharge amount from the compressor is larger than an oil returning amount from a system connected to the compressor. As a result, an oil level becomes low. On the other hand, at the time of decreasing an acceleration, the oil discharge amount from the compressor is smaller than the oil returning amount from the system connected to the compressor. As a result, an oil level becomes high.

The present disclosure has been derived from this research result. The oil level detector configured to detect oil level may be disposed in the compressor. Through this oil level detector, changes of an oil level may be detected. The controller may control the oil level to be in a normal range by changing a rotation speed of a shaft when the oil level changes while increasing or decreasing the operating speed.

For instance, when it has been detected that the oil level became low at an acceleration section, the controller may control the operating speed of the compressor such that the oil level becomes high, by decreasing the operating speed or by performing a constant speed driving for a predetermined time. Here, the controller may decrease an acceleration of the operating speed when the oil level becomes low or reaches a level below a predetermined level.

More concretely, if it has been detected that the oil level became low in an acceleration mode with a speed of about 4 Hz per second, the acceleration may be lowered into about 2 Hz per second. In some cases, the acceleration of the operating speed may be stopped, and an operating speed corresponding to a time point when lowering of the oil level was detected may be maintained for a predetermined time.

The time for constantly maintaining the operating speed may be differently set according to a place where the compressor is installed. For instance, in a case that the compressor is installed at a polar region or a cold region, the time for constantly maintaining the operating speed may be set to be much longer than in a case that the compressor is installed at a warm region. The time for constantly maintaining the operating speed may not be determined in advance, but accelerating may be re-started when it is detected, by the oil level detector, that the oil level restored a normal range.

However, when the oil level may not be controlled through mere changes of the operating speed in some cases where the compressor is damaged or an absolute amount of oil is deficient, etc. If the oil level has restored a normal range despite the aforementioned controls, the compression being operated may be stopped.

The compression unit may include a cylinder providing a compression chamber, a rolling piston eccentrically installed in the cylinder, a shaft including an oil feeder at a lower portion thereof and engaged with the rolling piston, and upper and lower bearings disposed on upper and lower sides of the cylinder, respectively.

The controller may be configured to decrease an acceleration of the operating speed when the oil level is lower than an uppermost portion of the oil feeder while increasing the operating speed. More concretely, oil supply may not be smoothly performed if an operation is continuously performed in a state that the oil feeder is not sufficiently soaked in oil. In this case, the acceleration of the operation speed may be decreased such that the oil level is higher than an uppermost portion of the oil feeder, i.e., such that the oil feeder is completely soaked in oil.

The controller may control the operating speed of the compression unit to maintain a constant speed when the oil level is lower than a lowermost portion of the oil feeder while accelerating the operating speed. When the oil level has restored a level more than the lowermost portion of the oil feeder, the controller may control accelerating the operating speed of the compression unit to be re-started.

Alternatively, when the oil level is lower than the lowermost portion of the oil feeder while accelerating the operating speed, the controller may stop the acceleration of the operating speed, and may control the operating speed to maintain a constant speed for a predetermined time.

The oil level detector may be installed to extend between an interface of the upper bearing and the cylinder and the lowermost portion of the oil feeder, and may be configured to continuously check changes of the oil level.

A plurality of oil level detector may be disposed between an interface of the upper bearing and the cylinder and the lowermost portion of the oil feeder, and may be configured to check whether the oil level has reached each installation point.

The plurality of oil level detectors may be installed at a height of a lower surface of the rolling piston, an uppermost portion of the oil feeder and a lowermost portion of the oil feeder, respectively.

The one or more oil level detectors may include a plurality of heating wires disposed on an inner surface of the oil storage portion, a power supply unit configured to provide an alternating current to the heating wires, and a signal processor configured to process signals from the heating wires. When the alternating current is applied to the heating wires, amplitudes of temperature changes may become different according to a thermal property of a working fluid near the heating wires. The signal processor may detect amplitudes of temperature changes thus to detect an oil level. Here, the signal processor may detect an amplitude of temperature changes of the heating wires by a 3ω method.

In accordance with another embodiment, an operating method for a compressor includes accelerating an operating speed of a compressor, detecting an oil level inside the compressor while accelerating the operating speed, and decreasing the acceleration of the operating speed when the detected oil level is lower than a predetermined first level.

The first level may be set as a level higher than an allowable minimized value of an oil level inside the compressor.

The method may further include stopping the acceleration of the operating speed and constantly maintaining the operating speed for a predetermined time when the detected oil level is lower than a predetermined second level.

The second level may be set as a level equal to an allowable minimized value of an oil level inside the compressor.

The method may further include stopping the acceleration of the operating speed and constantly maintaining the operating speed when the oil level is lower than the predetermined second level, and restarting the acceleration of the operating speed when the oil level has restored a level more than the second level.

The compressor may include a cylinder providing a compression chamber, a rolling piston eccentrically installed in the cylinder, a shaft including an oil feeder at a lower portion thereof and engaged with the rolling piston, and upper and lower bearings disposed on upper and lower sides of the cylinder, respectively, wherein the first level is determined to correspond to a height of an uppermost portion of the oil feeder. The second level may be determined to correspond to a height of a lowermost portion of the oil feeder.

The operating speed maintained as a constant speed may be a speed corresponding to a time point when it has been detected that the oil level is lower than the second level.

One or more embodiments disclosed herein, therefore, may oil level may control the oil level in a compressor to within a predetermined range even while changing the operating speed of the compressor. This may enhance the reliability and the lifespan of the compressor.

In accordance with another embodiment, a compression device comprises a casing; a compressor in the casing; a driver to drive the compressor; a detector to detect a level of oil in an oil storage area; and a controller to control an operating speed of the compressor based on the detected oil level, wherein, during a speed-change operation, the controller controls acceleration of the compressor to maintain the oil level within a predetermined range when the oil level is detected to be outside the predetermined range.

The controller may decrease acceleration of the compressor when a decrease in the oil level is detected during the speed-change operation, or may decrease acceleration of the compressor when the oil level is detected to be below the predetermined range during the speed-change operation.

Also, the controller may stop acceleration of the compressor and maintain the operating speed of the compressor at a substantially constant speed for a predetermined time when the oil level is detected to be below the predetermined range during the speed-change operation.

The compressor may comprise a cylinder with a compression chamber; a rolling piston eccentrically coupled to the cylinder; a shaft including an oil feeder coupled to the rolling piston; and upper and lower bearings adjacent upper and lower sides of the cylinder, respectively.

In accordance with one embodiment, the controller may decrease acceleration of the compressor when the oil level is detected to be lower than a lower surface of the rolling piston during the speed-change operation.

In accordance with another embodiment, the controller may stop acceleration of the compressor and maintains the operating speed of the compressor at a substantially constant speed for a predetermined time when the oil level is detected to be lower than a lowermost portion of the oil feeder during the speed-change operation. The predetermined time may be based on an ambient temperature of the compressor.

Also, the oil level detector may be located between an interface of the upper bearing and cylinder, and a lower portion of the oil feeder. The oil level detector may include a plurality of heating wires; a power supply to provide current to the heating wires; and a signal processor to process signals from the heating wires to determine the oil level in the oil storage area.

In accordance with one embodiment, the device may include a plurality of oil level detectors between an interface of the upper bearing and cylinder and a lower portion of the feeder. The plurality of oil level detectors may be located at a height substantially coincident with a lower surface of the rolling piston, an upper portion of the oil feeder, and a lower portion of the oil feeder, respectively.

In accordance with another embodiment, a method of controlling a compressor comprises performing an speed-change operation for the compressor; detecting an oil level during the speed-change operation; and changing acceleration of the compressor when the detected oil level is lower than a predetermined first level.

Further, the method may include stopping acceleration of the compressor and maintaining the compressor at a substantially constant operating speed for a predetermined time when the detected oil level is lower than a predetermined second level. The predetermined time to constantly maintain the operating speed may be determined based on the ambient temperature of the compressor. The constantly maintained speed may correspond to the operating speed at the time when it is detected that the oil level is lower than the second level.

The compressor may comprise a cylinder with a compression chamber; a rolling piston eccentrically located in the cylinder; a shaft having an oil feeder at a lower portion thereof and engaged with the rolling piston; and upper and lower bearings on upper and lower sides of the cylinder, respectively, wherein the first predetermined level corresponds to a height of a upper portion of the oil feeder.

Alternatively, the compressor may comprise a cylinder with a compression chamber; a rolling piston eccentrically located in the cylinder; a shaft including an oil feeder at a lower portion thereof and engaged with the rolling piston; and upper and lower bearings on upper and lower sides of the cylinder, respectively, wherein the second predetermined level corresponds to a height of a lower portion of the oil feeder.

In accordance with another embodiment, a compression device comprises a compressor; a driver to drive the compressor; a detector to detect a level of oil in an oil storage area; and a controller to control a rate of change of a speed of the compressor during a speed-change operation, wherein the controller changes the rate of change of the compressor speed based on the detected oil level during the speed-change operation, the rate of change of the compressor speed causing an amount of oil in the oil storage area to change.

The controller may decrease the rate of change of the compressor speed when the detected oil level is lower than a predetermined level, the decrease in the rate of change of the compressor speed causing the level of oil in the oil storage area to increase above the predetermined level. The rate of change of the compressor speed may be a deceleration or an acceleration of the compressor.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of any one embodiment may be combined with one or more features of the remaining embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compression device, comprising:
- a casing;
- a compressor in the casing, the compressor comprising:
  - a cylinder with a compression chamber;
  - a rolling piston eccentrically coupled to the cylinder;
  - a shaft including an oil feeder coupled to the rolling piston; and
  - upper and lower bearings adjacent upper and lower sides of the cylinder, respectively;
- a driver to drive the compressor;
- a detector to detect a level of oil in an oil storage area; and
- a controller to control an operating speed of the compressor based on the detected oil level,
- wherein, during a speed-change operation, the controller controls acceleration of the compressor to maintain the oil level within a predetermined range when the oil level is detected to be outside the predetermined range, and
- wherein the controller stops acceleration of the compressor and maintains the operating speed of the compressor at a substantially constant speed for a predetermined time when the oil level is detected to be lower than a lowermost portion of the oil feeder during the speed-change operation.

2. The device of claim 1, wherein the controller decreases acceleration of the compressor when a decrease in the oil level is detected during the speed-change operation.

3. The device of claim 1, wherein the controller decreases acceleration of the compressor when the oil level is detected to be below the predetermined range during the speed-change operation.

4. The device of claim 1, wherein the controller stops acceleration of the compressor and maintains the operating speed of the compressor at a substantially constant speed for a predetermined time when the oil level is detected to be below the predetermined range during the speed-change operation.

5. The device of claim 1, wherein the controller decreases acceleration of the compressor when the oil level is detected to be lower than a lower surface of the rolling piston during the speed-change operation.

6. The device of claim 1, wherein the predetermined time is based on an ambient temperature of the compressor.

7. The device of claim 1, wherein the oil level detector is between an interface of the upper bearing and cylinder, and a lower portion of the oil feeder.

8. The device of claim 1, wherein the oil level detector includes:
- a plurality of heating wires;
- a power supply to provide current to the heating wires; and
- a signal processor to process signals from the heating wires to determine the oil level in the oil storage area.

9. A compression device, comprising:
- a compressor, comprising:
  - a cylinder with a compression chamber;
  - a rolling piston eccentrically coupled to the cylinder;
  - a shaft including an oil feeder coupled to the rolling piston; and
  - upper and lower bearings adjacent upper and lower sides of the cylinder, respectively;

a driver to drive the compressor;

a detector to detect a level of oil in an oil storage area; and a controller to control a rate of change of a speed of the compressor during a speed-change operation, wherein the controller changes the rate of change of the compressor speed based on the detected oil level during the speed-change operation, the rate of change of the compressor speed causing an amount of oil in the oil storage area to change, and wherein the controller makes a rate of change of a speed of the compressor to zero and maintains the operating speed of the compressor at a substantially constant speed for a redetermined time when the oil level is detected to be lower than a lowermost portion of the oil feeder during the speed-change operation.

10. The device of claim 9, wherein the controller decreases the rate of change of the compressor speed when the detected oil level is lower than a predetermined level, the decrease in the rate of change of the compressor speed causing the level of oil in the oil storage area to increase above the predetermined level.

11. A compression device, comprising:

a casing;

a compressor in the casing, the compressor comprising:

a cylinder with a compression chamber;

a rolling piston eccentrically coupled to the cylinder;

a shaft including an oil feeder coupled to the rolling piston; and upper and lower bearings adjacent upper and lower sides of the cylinder, respectively;

a driver to drive the compressor;

a plurality of oil level detectors to detect a level of oil in an oil storage area; and a controller to control an operating speed of the compressor based on the detected oil level, wherein, during a speed-change operation, the controller controls acceleration of the compressor to maintain the oil level within a predetermined range when the oil level is detected to be outside the predetermined range, and wherein the plurality of oil level detectors are located at a height substantially coincident with a lower surface of the rolling piston, an upper portion of the oil feeder, and a lower portion of the oil feeder, respectively.

12. The device of claim 11, wherein the controller decreases acceleration of the compressor when a decrease in the oil level is detected during the speed-change operation.

13. The device of claim 11, wherein the controller decreases acceleration of the compressor when the oil level is detected to be below the predetermined range during the speed-change operation.

14. The device of claim 11, wherein the controller stops acceleration of the compressor and maintains the operating speed of the compressor at a substantially constant speed for a predetermined time when the oil level is detected to be below the predetermined range during the speed-change operation.

15. The device of claim 11, wherein the controller decreases acceleration of the compressor when the oil level is detected to be lower than a lower surface of the rolling piston during the speed-change operation.

16. The device of claim 14, wherein the predetermined time is based on an ambient temperature of the compressor.

17. The device of claim 11, wherein each of the plurality of oil level detectors includes:

a plurality of heating wires;

a power supply to provide current to the heating wires; and a signal processor to process signals from the heating wires to determine the oil level in the oil storage area.

* * * * *